United States Patent [19]

Miyagawa et al.

[11] Patent Number: 4,551,600

[45] Date of Patent: Nov. 5, 1985

[54] VENTILATED COOKING APPLIANCE UNIT

[75] Inventors: Junichi Miyagawa, Neyagawa; Yukio Hirai, Takarazuka, both of Japan

[73] Assignee: Matsushita Electric Industrial Co., Ltd., Osaka, Japan

[21] Appl. No.: 567,845

[22] PCT Filed: Apr. 14, 1983

[86] PCT No.: PCT/JP83/00117

§ 371 Date: Dec. 14, 1983

§ 102(e) Date: Dec. 14, 1983

[87] PCT Pub. No.: WO83/03735

PCT Pub. Date: Oct. 27, 1983

[30] Foreign Application Priority Data

Apr. 14, 1982 [JP] Japan ..... 57-62741

[51] Int. Cl.[4] ..... H05B 6/12; F24C 15/10

[52] U.S. Cl. ..... 219/10.49 R; 219/10.67; 219/447; 219/460; 126/37 A; 126/39 K; 126/299 D; 99/340

[58] Field of Search ..... 219/10.49 R, 10.67, 219/10.75, 10.55 R, 460, 462, 447, 444, 400; 126/37 A, 299 D, 39 H, 39 N, 39 J, 39 K; 99/340, DIG. 14; 361/384

[56] References Cited

U.S. PATENT DOCUMENTS

| | | | |
|---|---|---|---|
| 4,216,370 | 8/1980 | Charvat | 219/460 |
| 4,415,788 | 11/1983 | Field | 219/10.49 R |
| 4,431,892 | 2/1984 | White | 219/10.49 R |
| 4,468,548 | 8/1984 | Yamaki | 219/10.67 X |

FOREIGN PATENT DOCUMENTS

| | | | |
|---|---|---|---|
| 2340513 | 9/1977 | France | 219/10.49 R |
| 52-57343 | 4/1977 | Japan . | |
| 54-14039 | 2/1979 | Japan | 219/10.55 R |
| 56-158094 | 11/1981 | Japan . | |
| 58-4055 | 4/1983 | Japan . | |

*Primary Examiner*—Philip H. Leung
*Attorney, Agent, or Firm*—Wenderoth, Lind & Ponack

[57] ABSTRACT

A cooking appliance unit including a top plate on which food items are cooked, a horizontal frame formed around the outer periphery of the top plate, having inlet and outlet ventilation holes on only one side thereof, and a cooking appliance body below the plate and frame having walls defining first, second and third chambers therein. A heating device is provided in the second chamber below the top plate. A control device is provided in the first chamber, the first chamber being in fluid communication with the inlet holes, and the second chamber through a ventilation opening in a partition wall. The third chamber is disposed below the second chamber separated by another partition wall which contains a cooling fan, the third chamber being in fluid communication with the exhaust holes. Thus, the cooling fan draws air through the inlet holes to first cool the control device in the first chamber and then to the second chamber to cool the heating device before being exhausted through the third chamber to the exhaust holes.

4 Claims, 7 Drawing Figures

VENTILATED COOKING APPLIANCE UNIT

TECHNICAL FIELD

The present invention relates to a mechanism for cooling the interior of a cooking appliance unit, such as an induction heating type cooking appliance, buit in the top plate of a kitchen implement, said mechanism being designed so that a special processing or construction for cooling is not required on the part of the cooking implement.

BACKGROUND ART

Conventionally, when this type of cooking appliance unit is to be built in a kitchen implement, it has been necessary to provide ventilation holes in the kitchen implement so that cooling air leads to a cooling fan installed in order to suppress an internal temperature rise of the equipment due to the heat from the pot being heated or the heat produced by the inner heating section. The provision of such ventilation holes in the kitchen implement, however, has been fraught with problems from the standpoint of the external appearance of the kitchen implement and the difficulty of the processing.

DISCLOSURE OF THE INVENTION

Accordingly, the present invention is intended to provide an arrangement wherein a cooking appliance unit itself is provided with an independent ventilation passage to make it possible to effect cooling without having to pay heed to the kitchen implement, thereby solving the aforesaid problem of use, and wherein the suction and exhaust holes are concentrated on one side of the cooling area, thereby facilitating cooking and improving the aesthetic value of the external apperance.

BEST MODE OF CARRYING OUT THE INVENTION

Figure 1:
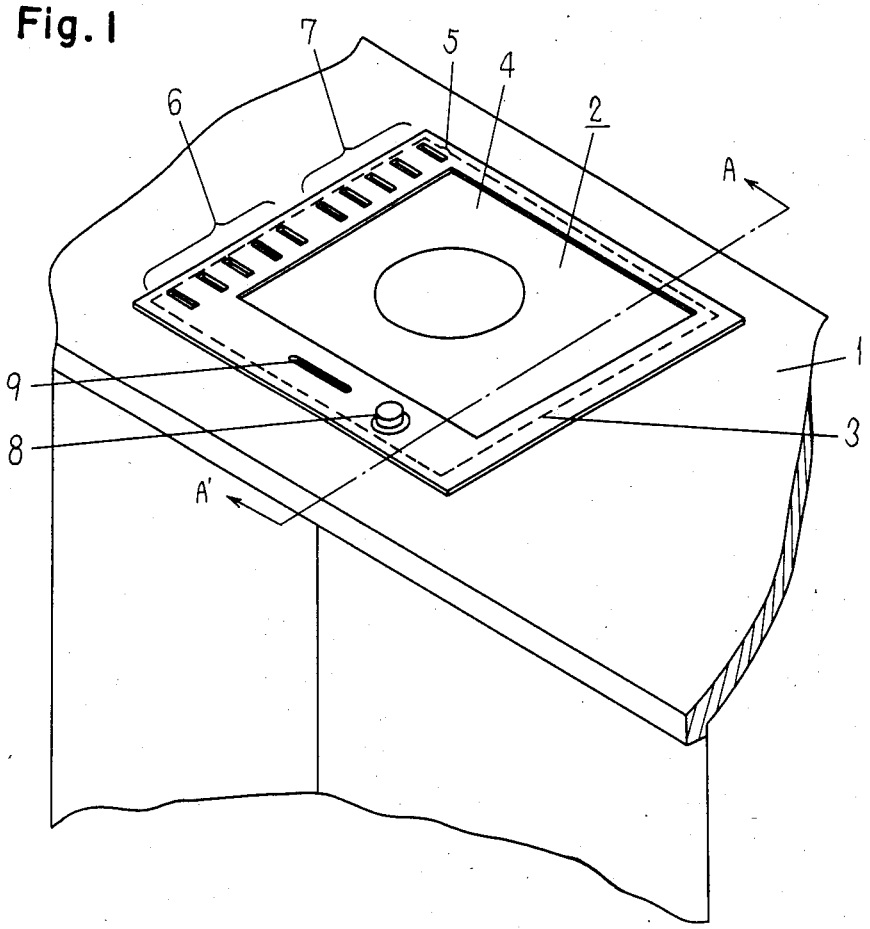
FIG. 1 is a perspective view of a kitchen implement having a cooking appliance unit built therein according to an embodiment of the present invention.
Figure 2:
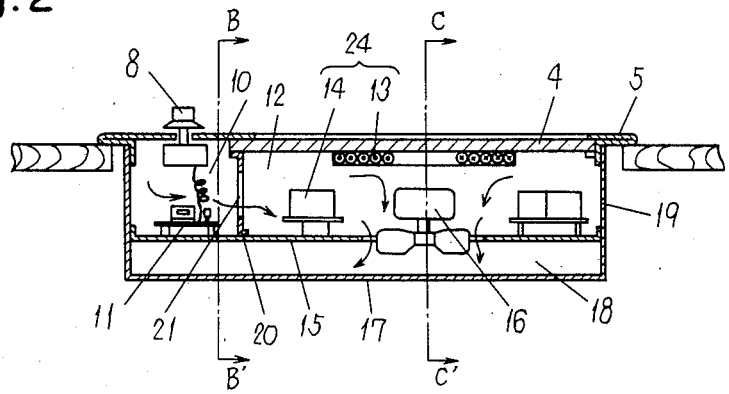
FIG. 2 is a sectional view taken along the line A—A' in FIG. 1.

In FIG. 1, the numeral 1 denotes the top plate of a kitchen sink or kitchen table, and numeral 2 denotes the body of a cooking appliance unit such as an induction heating type cooling appliance removably built in an opening 3 in said top plate 1. The numeral 4 denotes a top plate serving as a cooking area, having a frame 5 installed therearound. One side of said frame 5 is formed with a first group of ventilation holes 6 and a second group of ventilatin holes 7, each group consisting of a pluraity of slits, said groups being disposed adjacent each other. The numeral 8 denotes a control switch mounted on one side of the frame 5, numeral 9 denotes an indicator for indicating the output as the control switch 8 is manipulated. FIG. 2 is a sectional view taken along the line A—A40 in FIG. 1 In this figure, numeral 10 denotes a first chamber having a control device 11 for output adjustment and indication. The numeral 12 denotes a second chamber having a heating coil 13 and a high frequency power source circuit 14. The numeral 15 denotes a flat plate chassis which supports the parts positioned in the first and second chambers 10 and 12. The numeral 16 denotes a cooling fan installed in said second chamber 12 to project through part of said plate chassis 15 to be opposed to a body bottom plate 17.

Figure 3:
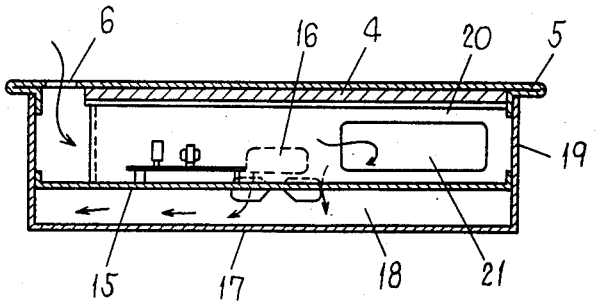
FIG. 3 is a sectional view taken along the line B—B' in FIG. 2.
Figure 4:
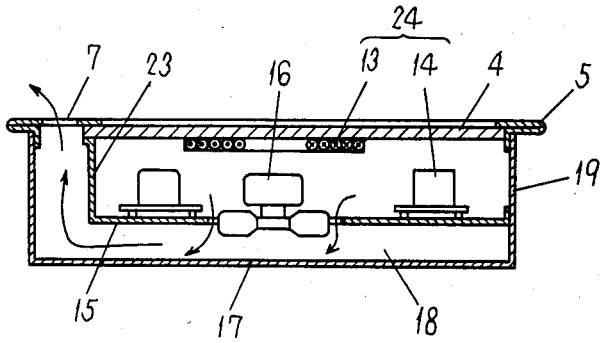
FIG. 4 is a sectional view taken along the line C—C' in FIG. 2.
Figure 5:
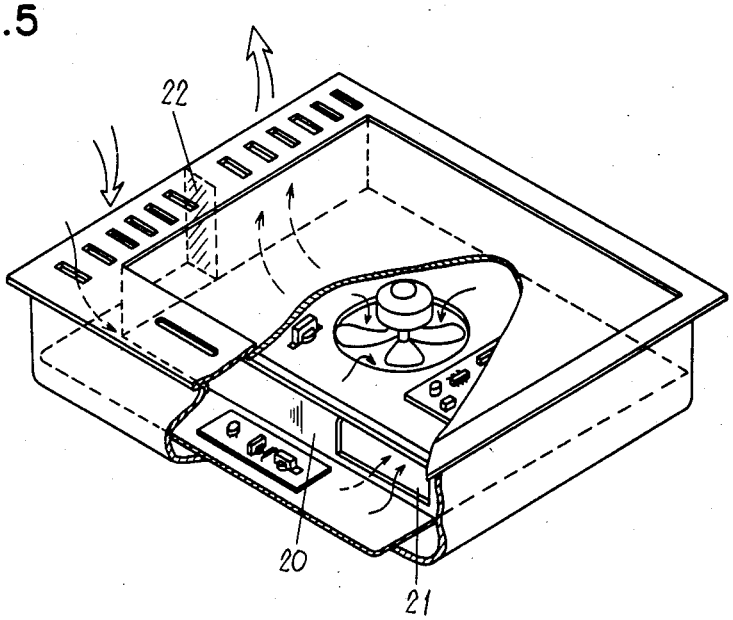
FIG. 5 is a perspective view of the principal portion of the cooking appliance unit.

In FIGS. 3, 4 and 5, said body bottom plate 17 defines a third chamber 18 below said flat plate chassis 15 and has a construction which leads the air from said cooling fan to said second group of ventilation holes 7. The numeral 19 denotes a body side wall. The numeral 20 denotes a partition plate separating said first and second chambers 10 and 12 from each other, and having a third group of ventilation holes 21 on the side opposite to said first ventilation holes 6 (within the body). The numeral 22 denotes a side wall positioned between said first and second groups of ventilation holes 6 and 7 to separate their air currents from each other. The first group of ventilation holes 6 is adapted to communicate with said first chamer 10 by means of said body side wall 19 and said flat plate chassis 15.

The numeral 23 denotes a partition wall for preventing direct ventilation between the second chamber 12 and the second group of ventilation holes 7. Further, said heating coil 13 and high frequency power source circuit 14 are collectively referred to as a heating device 24.

In the embodiment arranged in the manner described above, the cooling mechanism will now be described.

In FIGS. 2, 3, 4 and 5, when the cooking appliance unit body 2 is energized, the cooling fan 16 is operated for interior ventilation. That is, cooling air is sucked from the first group of ventilation holes group 6, passing through the first chamber 10 and the third group of ventilation holes 21 in the partition plate 20 to enter the second chamber 12, where it is sucked by the cooling fan, which delivers it into the third chamber 18, from which it is guided by the body bottom plate 17 and body side plate 19, and it is finally discharged out of the appliance through the second group of ventilation holes 7.

Because of ventilation by this cooling air, the parts and devices placed in the ventilation passage are gradually cooled, and as in the present embodiment, when cooling air is led from the first chamber 10 housing the control device to the second chamber 12 housing the heating section, the ventilation is directed from the lower to the higher temperature region, so that cooling efficiency is improved. Further, the parts housed in the first chamber 10 may be ones which have a reduced temperature resistance and which are inexpensive. Further, in the aforesaid arrangement, since the third group of ventilation holes group 21 formed in the partition plate 20 is located on the side opposite to said first group of ventilation holes 6, the cooling air can be led into the first chamber 10 and second chamber 12, a fact which forms an important factor for the arrangement wherein the suction and exhaust holes (the first and second group of ventilation holes 6 and 7) are concentrated on one side, which is a feature of the present invention.

Figure 6:
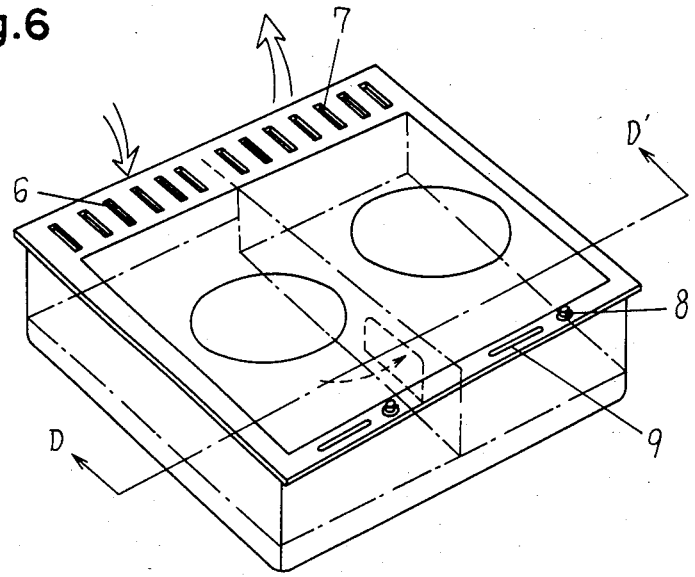
FIG. 6 is a perspective view of the principal portion of a cooking appliance unit according to another embodiment of the present invention.
Figure 7:
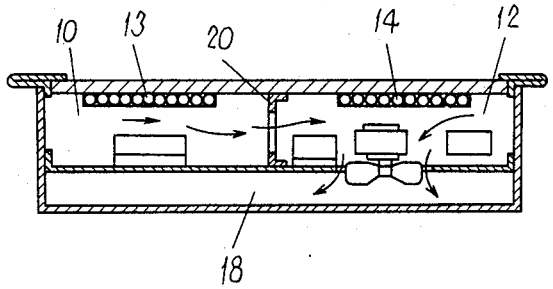
FIG. 7 is a sectional view taken along the line D—D' in FIG. 6.

The first chamber 10, like the second chamber, may be provided with not only a control device 11 but also a heating coil 13 and a high frequency power source circuit 14. Such an embodiment is shown in FIGS. 6 and 7.

As is clear from the above, since the cooking appliance unit itself is equipped with an independent cooling mechanism as described above, the kitchen implement in which the unit is to be build does not need to be formed with suction and exhaust holes and hence the mounting operation is very easy. Additionally the following are cited as inherent effects of the present invention.

First, the formation of suction and exhaust holes on one side makes it possible to enlarge the cooking area. That is, when a cooking appliance having an independent suction and exhaust construction as in the present inventin is to be built in the top plate or the like, if the suction and exhaust holes are formed in separate peripheral edges, the user must take care not to accidentally spill broth or water in such edges; thus, cooking operation is further limited. If the holes are concentrated on the same side, a larger space can be utilized for cooking.

Second, as in the present arrangement, the presence of the third chamber 18 from the cooling fan 16 to the exhaust holes (the second ventilation holes 7) has an effect that where the present cooking appliance is installed in the top of another heating device such as an oven or range, it shields the cooking appliance from produced from such device, making it possible to eliminate the influence of heat from the outside, particularly from the lower region.

The present invention provides an arrangement wherein one side of the frame of the top plate of a cooking appliance is formed with suction and exhaust holes and an independent ventilation passage is formed in the inside; thus, it is posssible to provide a cooking appliance unit wherein the mounting operation and cooking work are facilitated and the influence of heat from another heating device can be avoided.

What is claimed is:

1. A cooking appliance unit, comprising:

(a) a horizontal top plate having a plurality of sides defining an outer periphery and having means for transmitting heat to food items placed thereon;

(b) a horizontal frame formed on each of said plurality of sides of said outer periphery so as to surround said plate; said plate having vertically directed inlet ventilating holes and vertically directed exhaust ventilating holes on only one of said plurality of sides thereof;

(c) a cooking appliance body below said plate and said frame having a plurality of walls defining mutually separated first, second and third chambers enclosed therein, said plurality of walls including a bottom wall having said third chamber directly thereabove, a first inner wall above said bottom wall having said second chamber thereabove, separating said third chamber from said second chamber, and a second inner wall separating said first chamber from said second chamber; said inlet ventilating holes being in fluid communication with said first chamber; said exhaust ventilating holes being in fluid communication with said third chamber; said second inner wall having at least one ventilation opening providing fluid communication between said first and second chamber; said first inner wall having means therein for providing fluid communication between said second and third chamber;

(d) first means for heating said heat transmitting means, disposed in said second chamber;

(e) means for controlling said first heating means, disposed in said first chamber; and (f) means for drawing a flow of cooling air successively through said inlet holes, said first chamber, said at least one ventilation opening, said second chamber, said means for providing fluid communication between said second and third chamber, said third chamber and said exhaust holes.

2. A cooking appliance unit as in claim 1, further comprising second means for heating said heat transmitting means, disposed on said first chamber.

3. A cooking appliance unit as in claim 1, wherein said drawing means comprises a fan disposed in said fluid communication providing means in said first inner wall.

4. A cooking appliance as in claim 1, wherein said plurality of sides includes an opposite side opposite said only one of said plurality of sides, said first chamber and said second inner wall extending from said opposite side to said only one of said plurality of sides, said at least one ventilation opening being located adjacent said opposite side.

* * * * *